US007878774B2

(12) United States Patent
Speckert

(10) Patent No.: US 7,878,774 B2
(45) Date of Patent: Feb. 1, 2011

(54) MOINEAU STATOR INCLUDING A SKELETAL REINFORCEMENT

(75) Inventor: Michael Allen Speckert, West Chester, OH (US)

(73) Assignee: Smith International, Inc., Houston, TX (US)

( * ) Notice: Subject to any disclaimer, the term of this patent is extended or adjusted under 35 U.S.C. 154(b) by 829 days.

(21) Appl. No.: 11/810,202

(22) Filed: Jun. 5, 2007

(65) Prior Publication Data

US 2008/0304991 A1 Dec. 11, 2008

(51) Int. Cl.

| | |
|---|---|
| ***F01C 1/10*** | (2006.01) |
| ***F01C 5/00*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/48; 418/1; 418/153; 418/179; 29/888.023

(58) Field of Classification Search ..... 418/1, 418/48, 152–154, 178, 179; 29/888.023, 29/888.02

See application file for complete search history.

(56) References Cited

U.S. PATENT DOCUMENTS

| | | | | |
|---|---|---|---|---|
| 3,268,997 | A | 8/1966 | Miller | |
| 3,526,953 | A | 9/1970 | Levinstein | |
| 3,912,426 | A | 10/1975 | Tschirky | |
| 3,975,120 | A | 8/1976 | Tschirky | |
| 3,975,121 | A | 8/1976 | Tschirky | |
| 4,144,001 | A | 3/1979 | Streicher | |
| 4,676,725 | A | 6/1987 | Eppink | |
| 5,145,342 | A * | 9/1992 | Gruber | 418/48 |
| 5,171,138 | A | 12/1992 | Forrest | |
| 5,171,139 | A | 12/1992 | Underwood et al. | |
| 5,439,359 | A | 8/1995 | Leroy et al. | |
| 5,474,432 | A | 12/1995 | Hulley et al. | |
| 5,785,913 | A | 7/1998 | Clark et al. | |
| 5,832,604 | A | 11/1998 | Johnson et al. | |
| 6,037,065 | A * | 3/2000 | Hajmrle et al. | 428/570 |
| 6,102,681 | A | 8/2000 | Turner | |
| 6,241,494 | B1 | 6/2001 | Pafitis et al. | |
| 6,293,358 | B1 | 9/2001 | Jaget | |
| 6,309,195 | B1 | 10/2001 | Bottos et al. | |
| 6,427,787 | B1 | 8/2002 | Jaget | |
| 6,543,132 | B1 | 4/2003 | Krueger et al. | |
| 6,568,076 | B2 | 5/2003 | Bottos et al. | |
| 6,604,921 | B1 | 8/2003 | Plop et al. | |

(Continued)

FOREIGN PATENT DOCUMENTS

| | | | | |
|---|---|---|---|---|
| DE | 2713468 | A * | 9/1978 | 418/48 |

OTHER PUBLICATIONS

Office Action dated Apr. 2, 2010 for related U.S. Appl. No. 11/810,203, filed Jun. 5, 2010.

(Continued)

*Primary Examiner*—Theresa Trieu

(57) ABSTRACT

A Moineau style stator includes a helical cavity component having reinforced helical lobes. The lobes are reinforced with a three-dimensional network of physically bonded aggregate particles. The network of bonded aggregate provides a porous skeletal-like structural reinforcement. Pore volume between the bonded aggregate particles may optionally be partially or substantially filled with an elastomer. An elastomer liner is typically deployed on an inner surface of the helical lobes to promote a rotational interference fit with a rotor.

27 Claims, 3 Drawing Sheets

U.S. PATENT DOCUMENTS

| | | | | |
|---|---|---|---|---|
| 6,604,922 | B1 | 8/2003 | Hache | |
| 6,881,045 | B2 | 4/2005 | Zitka et al. | |
| 6,944,935 | B2 | 9/2005 | Hache | |
| 7,083,401 | B2 * | 8/2006 | Hooper | 418/48 |
| 7,130,108 | B2 * | 10/2006 | Yang et al. | 359/296 |
| 7,396,220 | B2 | 7/2008 | Norton et al. | |
| 2005/0079083 | A1 | 4/2005 | Lievestro et al. | |
| 2005/0089429 | A1 | 4/2005 | Delpassand et al. | |
| 2005/0089430 | A1 | 4/2005 | Hooper | |
| 2005/0118040 | A1 | 6/2005 | Zitka et al. | |
| 2006/0029507 | A1 | 2/2006 | Kaiser et al. | |
| 2006/0182643 | A1 | 8/2006 | Delpassand et al. | |
| 2008/0023665 | A1 | 1/2008 | Weiser et al. | |
| 2008/0304992 | A1 | 12/2008 | Hooper et al. | |

OTHER PUBLICATIONS

Response dated Jul. 2, 2010 to Office Action dated Apr. 2, 2010 for related U.S. Appl. No. 11/810,203, filed Jun. 5, 2010.

International Search Report and Written Opinion dated Sep. 25, 2008 for corresponding application No. PCT/US2008/007060 (WO08/153891) filed Jun. 5, 2008.

International Search Report and Written Opinion dated Oct. 7, 2008 for related application No. PCT/US2008/007070 (WO08/153897) filed Jun. 5, 2008.

Republication of WO08/153897 with amended claims filed Dec. 8, 2008.

Informal Comments to the Written Opinion of the ISA dated Dec. 8, 2008 for related application No. PCT/US2008/007070 (WO08/153897) filed Jun. 5, 2008.

Informal Comments to the Written Opinion of the ISA dated Nov. 24, 2008 for corresponding application No. PCT/US2008/007060 (WO08/153891) filed Jun. 5, 2008.

* cited by examiner

MOINEAU STATOR INCLUDING A SKELETAL REINFORCEMENT

RELATED APPLICATIONS

None.

FIELD OF THE INVENTION

The present invention relates generally to positive displacement, Moineau style motors, typically for downhole use. This invention more specifically relates to Moineau style stators including a reinforced elastomer helical cavity component.

BACKGROUND OF THE INVENTION

Moineau style hydraulic motors and pumps are conventional in subterranean drilling and artificial lift applications, such as for oil and/or gas exploration. Such motors make use of hydraulic power from drilling fluid to provide torque and rotary power, for example, to a drill bit assembly. The power section of a typical Moineau style motor includes a helical rotor disposed within the helical cavity of a corresponding stator. When viewed in circular cross section, a typical stator shows a plurality of lobes in the helical cavity. In most conventional Moineau style power sections, the rotor lobes and the stator lobes are preferably disposed in an interference fit, with the rotor including one fewer lobe than the stator. Thus, when fluid, such as a conventional drilling fluid, is passed through the helical spaces between rotor and stator, the flow of fluid causes the rotor to rotate relative to the stator (which may be coupled, for example, to a drill string). The rotor may be coupled, for example, through a universal connection and an output shaft to a drill bit assembly.

Conventional stators typically include a helical cavity component bonded to an inner surface of a steel tube. The helical cavity component in such conventional stators typically includes an elastomer (e.g., rubber) and provides a resilient surface with which to facilitate the interference fit with the rotor. Many stators are known in the art in which the helical cavity component is made substantially entirely of a single elastomer layer.

It has been observed that during operations, the elastomer portions of conventional stator lobes are subject to considerable cyclic deflection, due at least in part to the interference fit with the rotor and reactive torque from the rotor. Such cyclic deflection is well known to cause a significant temperature rise in the elastomer. In conventional stators, especially those in which the helical cavity component is made substantially entirely from a single elastomer layer, the greatest temperature rise often occurs at or near the center of the helical lobes. The temperature rise is known to degrade and embrittle the elastomer, eventually causing cracks, cavities, and other types of failure in the lobes. Such elastomer degradation is known to reduce the expected operational life of the stator and necessitate premature replacement thereof. Left unchecked, degradation of the elastomer will eventually undermine the seal between the rotor and stator (essentially destroying the integrity of the interference fit), which results in fluid leakage therebetween. The fluid leakage in turn causes a loss of drive torque and eventually may cause failure of the motor (e.g., stalling of the rotor in the stator) if left unchecked.

Moreover, since such prior art stators include thick elastomer lobes, selection of the elastomer material necessitates a compromise in material properties to minimize lobe deformation under operational stresses and to achieve a suitable seal between rotor and stator. However, it has proved difficult to produce suitable elastomer materials that are both (i) rigid enough to prevent distortion of the stator lobes during operation (which is essential to achieving high drilling or pumping efficiencies) and (ii) resilient enough to perform the sealing function at the rotor stator interface. One solution to this problem has been to increase the length of power sections utilized in subterranean drilling applications. However, increasing stator length tends to increase fabrication cost and complexity and also increases the distance between the drill bit and downhole logging sensors. It is generally desirable to locate logging sensors as close as possible to the drill bit, since they tend to monitor conditions that are remote from the bit when located distant from the bit.

Stators including a reinforced helical cavity component have been developed to address this problem. For example, U.S. Pat. No. 5,171,138 to Forrest and U.S. Pat. No. 6,309,195 to Bottos et al. disclose stators having helical cavity components in which a thin elastomer liner is deployed on the inner surface of a rigid, metallic stator former. The '138 patent discloses a rigid, metallic stator former deployed in a stator tube. The '195 patent discloses a "thick walled" stator having inner and outer helical stator profiles. The use of such rigid stators is disclosed to preserve the shape of the stator lobes during normal operations (i.e., to prevent lobe deformation) and therefore to improve stator efficiency and torque transmission. Moreover, such metallic stators are also disclosed to provide greater heat dissipation than conventional stators including elastomer lobes.

While rigid stators have been disclosed to improve the performance of downhole power sections (e.g., to improve torque output), fabrication of such rigid stators is complex and expensive as compared to that of the above described conventional elastomer stators. Most fabrication processes utilized to produce long, internal, multi-lobed helixes in a metal reinforced stator are tooling intensive (such as helical broaching) and/or slow (such as electric discharge machining). As such, rigid stators of the prior art are often only used in demanding applications in which the added expense is acceptable.

Therefore, there exists a need for yet further improved stators and improved stator manufacturing methods for Moineau style drilling motors. Such stators and stator manufacturing methods would advantageously result in longer service life and improved efficiency in demanding downhole applications.

SUMMARY OF THE INVENTION

The present invention addresses one or more of the above-described drawbacks of conventional Moineau style motors and pumps. Aspects of this invention include a Moineau style stator for use in such motors and/or pumps, such as in a downhole drilling assembly. Stators in accordance with this invention include a helical cavity component having reinforced helical lobes. The lobes are typically reinforced with a three-dimensional network of physically bonded aggregate particles, for example, including plated steel spheres. The network of bonded aggregate provides a porous skeletal-like structural reinforcement. Pore volume between the bonded aggregate particles may be partially or substantially filled, for example, with a resilient material (such as an elastomer). The resilient material may also be deployed on an inner surface of the helical cavity component and presented to the internal helical cavity such that a rotational interference fit may be made with a rotor deployed in the stator.

Exemplary embodiments of the present invention advantageously provide several technical advantages. Exemplary embodiments of this invention address the heat build up and subsequent elastomer breakdown in the lobes of prior arts stators by providing reinforced stator lobes. As such, various embodiments of the Moineau style stator of this invention may exhibit prolonged service life as compared to conventional Moineau style stators. Further, exemplary stator embodiments of this invention may exhibit improved efficiency (and may thus provide improved torque output when used in power sections) as compared to conventional stators including an all elastomer helical cavity component. Moreover, since the resilient liner is integral with resilient material in the lobes it tends to be less prone to delamination than in prior art reinforced stators.

Reinforced stators in accordance with this invention are also typically less expensive to fabricate than reinforced stators of the prior art. Methods in accordance with this invention provide for excellent dimensional capability, full thickness of stator walls, and do not reduce the structural integrity of the stator or require time-consuming welding operations.

In one aspect, this invention includes a Moineau style stator. The stator includes an outer stator tube and a helical cavity component deployed substantially coaxially in the stator tube. The helical cavity component provides an internal helical cavity and includes a plurality of internal lobes. The helical cavity component includes a porous skeletal structure having a three-dimensional network of aggregate particles in which neighboring aggregate particles are physically bonded. A resilient liner is deployed on an inner surface of the helical cavity component and presented to the internal helical cavity. In various exemplary embodiments of the invention, pores in the porous skeletal structure are at least partially filled with an elastomeric material. The elastomeric material may further optionally be substantially identical in composition with the resilient liner and integral with the resilient liner.

In another aspect, this invention includes a method for fabricating a Moineau style stator. The method includes deploying a first stator core substantially coaxially into a stator tube, the stator core having at least one helical lobe on an outer surface thereof such that a first helical cavity is formed between the first stator core and the stator tube and filling the first helical cavity with a free flow aggregate. The method further includes bonding the free flow aggregate to form a porous, three-dimensional network of aggregate particles in which neighboring aggregate particles are physically bonded and removing the first stator core. The method still further includes deploying a second stator core in the stator tube, the second stator core having smaller major and minor diameters than the first stator core such that a second helical cavity is formed between the second stator core and the bonded aggregate particles and injecting a resilient material into the second helical cavity. The resilient material substantially fills the second helical cavity and at least partially fills pore space between the bonded aggregate particles. The second stator core is then removed from the stator.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
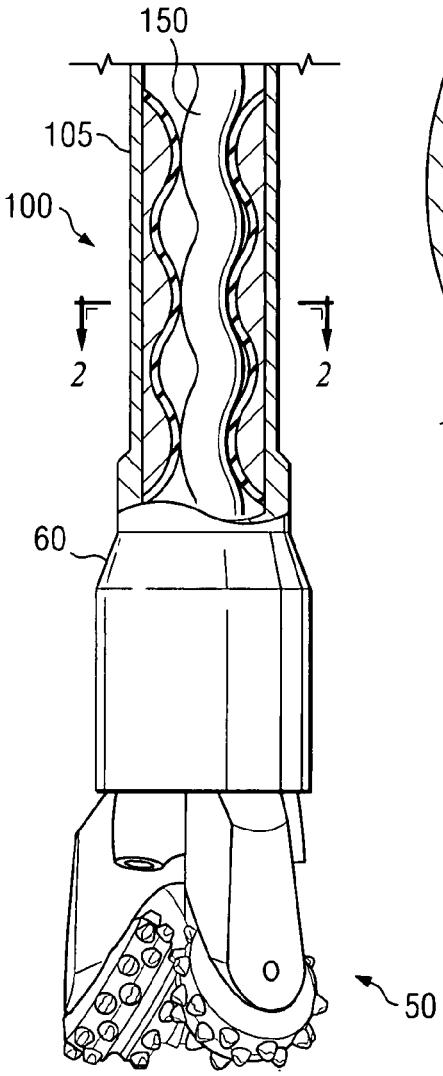
FIG. 1 depicts a conventional drill bit coupled to a Moineau style motor utilizing an exemplary stator embodiment of the present invention.

Referring first to FIGS. 1 through 6, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 6 may be described herein with respect to that reference numeral shown on other views.

Figure 2:
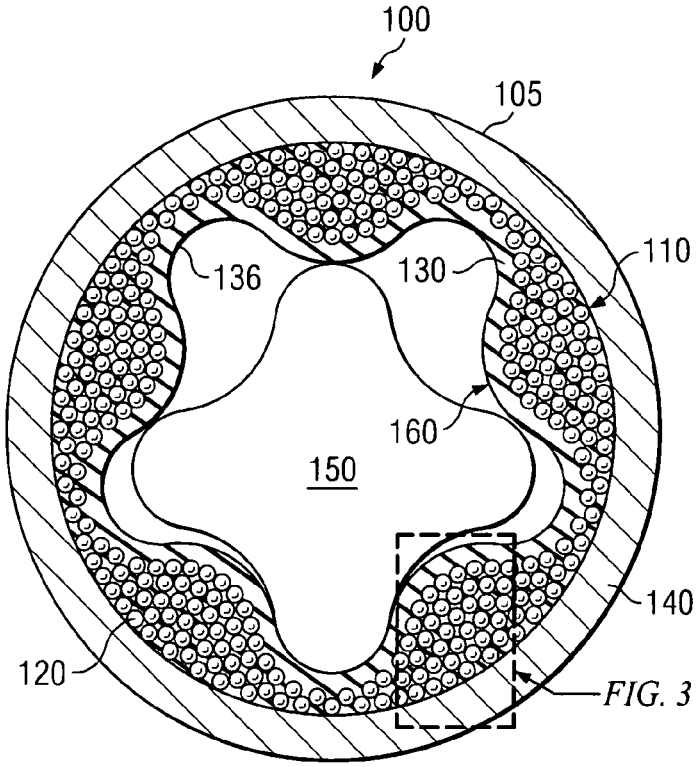
FIG. 2 is a circular cross sectional view of the Moineau style stator as shown on FIG. 1.

FIG. 2 depicts a circular cross-section through a Moineau style power section in an exemplary 4/5 design. In such a design, the differing helical configurations on the rotor and the stator provide, in circular cross section, 4 lobes on the rotor and 5 lobes on the stator. It will be appreciated that this 4/5 design is depicted purely for illustrative purposes only, and that the present invention is in no way limited to any particular choice of helical configurations for the power section design.

With reference now to FIG. 1, one exemplary embodiment of a Moineau style power section 100 according to this invention is shown in use in a downhole drilling motor 60. Drilling motor 60 includes a helical rotor 150 deployed in the helical cavity of Moineau style stator 105. In the embodiment shown on FIG. 1, drilling motor 60 is couples to a drill bit assembly 50 in a configuration suitable, for example, for drilling a subterranean borehole, such as in an oil and/or gas formation. It will be understood that the Moineau style stator 105 of this invention, while shown coupled to a drill bit assembly in FIG. 1, is not limited to downhole applications, but rather may be utilized in substantially any application in which Moineau style motors and/or pumps are used.

Turning now to FIG. 2, which is a cross-section as shown on FIG. 1, power section 100 is shown in circular cross section. Moineau style stator 105 includes an outer stator tube 140 (e.g., a steel tube) retaining a helical cavity portion 110. Helical cavity portion 110 includes a helical reinforcement component 120 and a resilient liner 130 on an inner surface thereof. Helical reinforcement component 120 is shaped to define a plurality of inner helical lobes 160 (and corresponding grooves). As described in more detail below with respect to FIG. 3, helical reinforcement component 120 includes a three-dimensional skeletal structure formed, for example, from a physically bonded, free flow aggregate material that replicates the helical profile. The resilient liner 130 is typically fabricated from a suitable elastomer material. In exemplary applications for use downhole in oil and gas exploration, the elastomer material is advantageously selected in view of an expectation of being exposed to various oil based compounds and high service temperatures and pressures.

Figure 3:
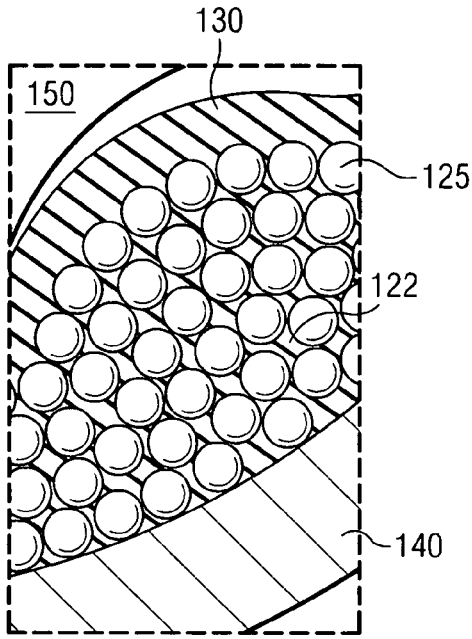
FIG. 3 depicts, in cross-section, a portion of the embodiment shown on FIG. 2.

With continued reference to FIG. 2 and further reference to FIG. 3, helical reinforcement component 120 may be advantageously fabricated from a free flow aggregate 125 in which neighboring aggregate particles are physically bonded together to form a three-dimensional structure replicating the helical profile. The aggregate 125 may be bonded together, for example, via a metallic plating material or a liquid adhesive (neither of which is shown on the FIGURES). In one advantageous embodiment, the aggregate 125 includes plated steel balls (spheres), although the invention is not limited in these regards. Steel aggregate is preferred, in part, because it tends to increase the strength of the helical reinforcement component 120 and because it results in the helical reinforcement component 120 having a thermal expansion coefficient similar to that of the stator tube 140 and stator core 170 (FIG. 5).

In FIG. 3, the aggregate 125 is shown to be approximately spherical. It will be appreciated that the invention is not limited in this regard. Suitable aggregate may be substantially any shape, angularity, and size, however aggregate having a roughly spherical shape is generally preferred owing to its superior free flow properties. FIG. 3 also shows aggregate having an approximately uniform particle size. The invention is also not limited in this regard, as a mixture of multiple particle sizes or distribution of particles sizes may be advantageously utilized for certain applications, e.g., to control pore size and volume between the aggregate particles 125. For example, if a pore volume of 30% is desired, a bimodal distribution of particles sizes may be selected to achieve the desired pore volume. In one advantageous embodiment substantially spherical aggregate having a diameter in the range from about 0.5 to about 3 mm may be utilized.

The pore spaces between the aggregate particles may optionally be partially or substantially filled with a resilient material 122, thereby forming a composite structure. It will be appreciated that the invention is not limited in this regard, as the pore volume may also remain unfilled or be partially or substantially filled with one or more alternative materials, such as liquid adhesives or metallic plating materials (e.g., a solder). Notwithstanding, the pore volume is preferably at least partially filled with a resilient material 122 (e.g., an elastomer) that is substantially identical in composition to and integral with the resilient liner 130. Alternatively, the pores may be filled (at least partially) with a first elastomeric material (e.g., a hard material that bonds well with the aggregate and the resilient liner formed with a second elastomeric material (e.g., a softer more chemically resistant material).

Figure 4:
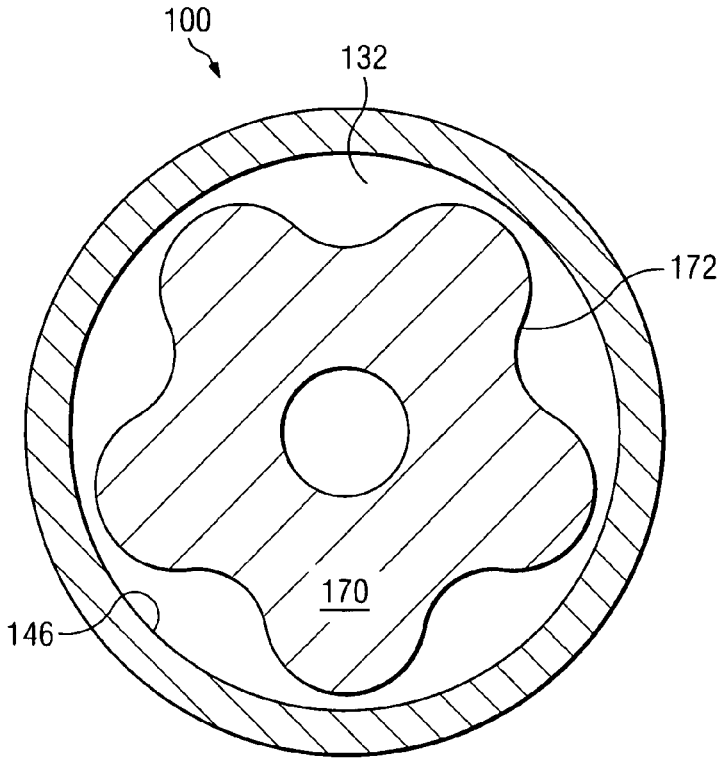
FIGS. 4 through 6 depict exemplary arrangements that may be used in the fabrication of the stator shown on FIGS. 2 and 3.
Figure 5:
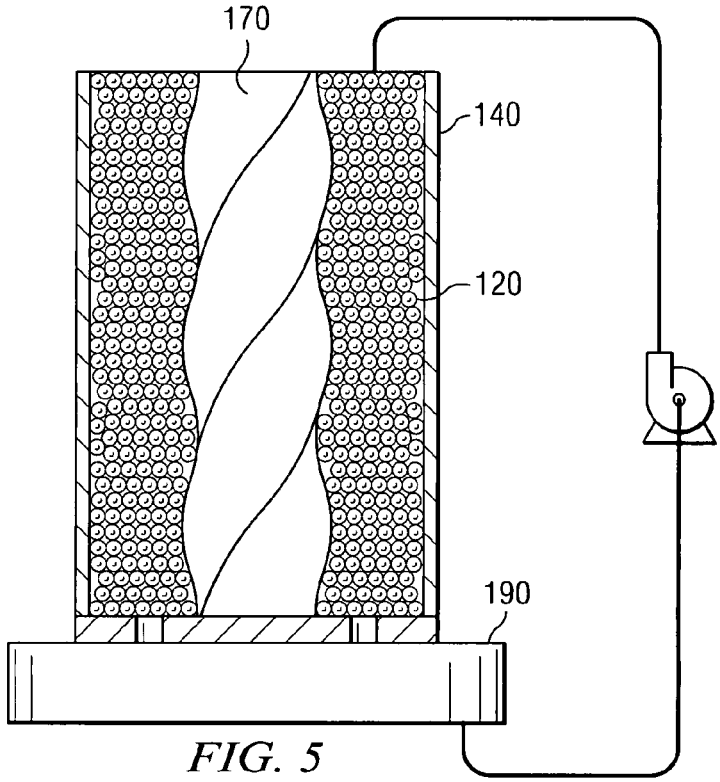
Figure 6:
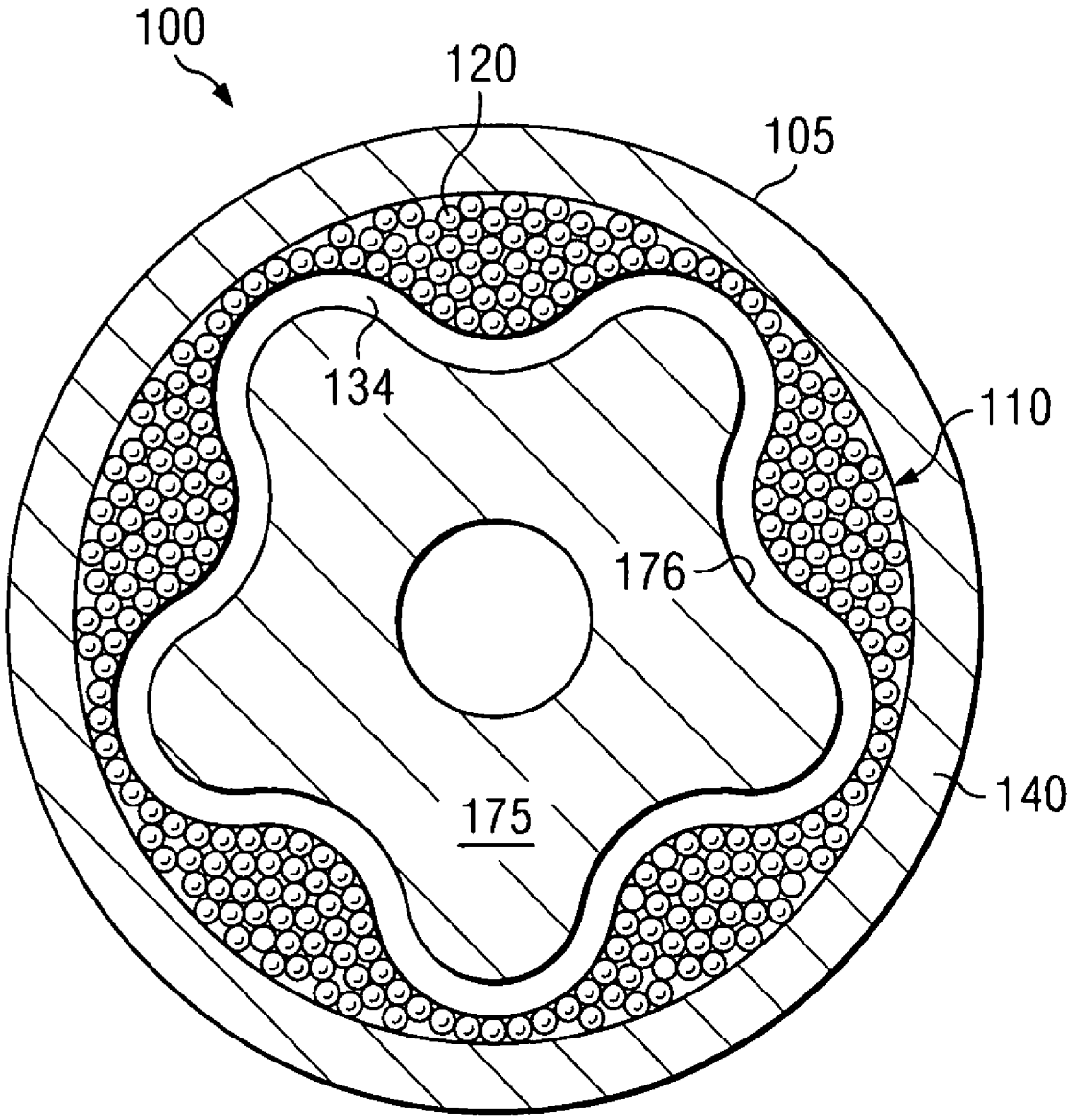

With reference to FIGS. 4-6, exemplary methods will now be described for fabricating various embodiments of the progressive cavity stator 105 of this invention. FIG. 4 shows (in circular cross section) a first stator core 170, having a plurality of helical grooves formed in an outer surface 172 thereof, deployed substantially coaxially in stator tube 140. The helical cavity 132 between the stator core 170 and stator tube 140 is typically first substantially filled with free flow aggregate 125. The aggregate may be bonded together to form a skeletal structure using substantially any suitable technique. For example, in one exemplary embodiment, the aggregate may be plated, for example, with a material having a melting temperature less than that of the aggregate particles 125 and the stator tube 140. Exemplary metallic plating materials include copper, nickel, tin, zinc, chromium, and various alloys thereof. Tin is typically advantageous due to its low melting temperature of about 232 degrees C. It will be appreciated that such plated aggregate may be plated using substantially any suitable technique including electrolytic and electroless processes.

After the helical cavity is filled with plated aggregate 125, the assembly (including the stator core 170 and the stator tube 140) is heated to a predetermined temperature (e.g., to a temperature greater than or equal to the melting temperature of the plating material) using substantially any known heating means. The assembly is then cooled and the stator core 170 removed. It will be appreciated that heating the assembly causes the plating material to partially or fully melt (depending on the predetermined temperature and time of heating). Upon cooling, the plating material re-solidifies thereby metallurgically bonding the aggregate together at the contact points between the individual particles (e.g., spheres as shown on FIG. 3).

FIG. 5 illustrates an alternative method for bonding the aggregate 125 in the helical cavity 132. In the exemplary embodiment shown, a plating solution (e.g., of liquid tin) may be percolated through the free flow aggregate 125 in the helical cavity 132. In the exemplary embodiment shown, the plating solution drains into a reservoir 190 and is re-circulated. The percolation process continues until sufficient plating material has been deposited on the aggregate 125 to metallurgically bond the aggregate particles 125 together. In another alternative embodiment, a liquid adhesive, such as a polyvinyl glue, may be percolated through the aggregate 125 in the helical cavity 132. For certain applications, the adhesive alone may provide suitable bonding strength between the aggregate particles 125. A dry particulate soldering or brazing material may optionally be percolated through the aggregate after the adhesive has partially dried. It will be appreciated that the adhesive will tend to remain wet the longest at the contact points between aggregate particles (due to the greater volume of adhesive remaining at these locations). The solder and/or braze powder will tend to adhere to the wet adhesive. Upon heating and cooling (as described above), the powder will melt and re-solidify thereby further bonding the aggregate 125 together.

It will be appreciated that the above described processes may be advantageously performed in a vacuum or inert gas atmosphere to prevent oxidation of the aggregate and/or solder/brazing/plating materials. It will also be appreciated that liquids (such as the above described plating material and/or a liquid adhesive) may be fed into the helical cavity 132 using substantially any suitable technique, including for example conventional injection and gravity feeding techniques. Vacuum techniques may also be utilized to assist drawing liquids through helical cavity 132. Additionally, vibration, shock, and/or stator tube rotation may be used to assist in packing the free flow aggregate and promoting movement of liquid and powder materials through the helical cavity.

It will be understood that bonding the aggregate results in a porous skeletal structure having a macroscopic shape resembling that of the helical cavity 132. The degree of porosity (and tortuosity thereof) depends upon several factors, including, for example, (i) the aggregate size and shape, (ii) whether or not the aggregate is plated, and (iii) the amount and kind of bonding agent utilized (if any). The invention is not limited to any particular pore size, volume, and/or tortuosity.

Prior to insertion of the stator core 170 in stator tube 140, the inner surface 146 of the stator tube 140 may be treated in order to improve the bonding of the solder thereto. Such surface treatment may include, for example, sandblasting, plasma etching, solvent, soap, and/or acid washing, fluxing, etching, caustic dipping, pickling, phosphating, and combinations thereof. Additionally, inner surface 146 of stator tube 140 may also be plated with a material that readily bonds with the above described plating material or solder/brazing material to promote metallurgical bonding between the bonded aggregate particles 125 and the stator tube 140. In exemplary embodiments in which tin plated aggregate 125 is used, inner surface 146 may be advantageously "tinned" to promote bonding of the helical reinforcement component 120 with the stator tube 140.

As described above, at least a portion of the stator tube 140 and stator core 170 are sometimes heated to promote bonding of the aggregate. Substantially any heating arrangements may be utilized, for example, including induction coils, heating blankets, resistive heating elements deployed inside the core, heat transfer fluid, and ovens. Induction coils, for example, may be deployed at multiple locations along the length of the stator or moved along the length of the stator during fabrication. Of course, the stator tube 140 and stator core 170 may alternatively be moved through one or more induction coils. After the assembly has been heated, the stator tube 140 and stator core 170 may optionally be cooled or quenched to accelerate bonding of the aggregate. Substantially any suitable techniques may be utilized, for example, including water or oil based quenching, circulating cooled heat transfer fluid through the stator core 170, and/or forced convection of air or mist (e.g., driven by one or more fans).

In such fabrication techniques, it is important to be able to remove the stator core 170 from the helical reinforcement component 120 after solidification of the solder. This may be accomplished by a variety of techniques. For example, stator core 170 may be advantageously fabricated from a material that has approximately the same thermal expansion coefficient as that of the helical reinforcement component 120 to prevent axial locking of the stator core 170 to the helical reinforcement component 120 after cooling. For example, when steel aggregate 125 is utilized, stator core 170 is typically fabricated from steel, although the invention is not limited in this regard.

After removal of stator core 170 from the bonded aggregate, a second stator core 175 is deployed substantially coaxially in stator tube 140 as shown on FIG. 6. In the exemplary embodiment shown, stator core 175 has a substantially identical shape in circular cross section to that of stator core 170 (FIG. 4), although the invention is not limited in this regard. Stator core 175 differs from stator core 170 in that it has smaller major and minor diameters than stator core 170, resulting in a helical cavity 134 being formed between the outer surface 176 of stator core 175 and the bonded aggregate 125. Helical space 134 is substantially filled with a resilient elastomeric material using conventional elastomer injection techniques. Injection of the elastomeric material into helical space 134 also tends to at least partially fill the tortuous porous network between the aggregate particles 125 with elastomer material. The resulting helical cavity component 110 is essentially a composite component including a physically bonded three-dimensional network of aggregate particles (the skeletal framework described above) having a pore volume that is at least partially filled withed an elastomeric material. Moreover, the inner helical surface 136 of the helical cavity component 110 is substantially all elastomer as shown on FIGS. 2 and 3, thereby promoting an interference fit with the rotor.

It will be appreciated that the resilient liner 130 and the resilient material 122 that fills the above described pore volume are advantageously integral and substantially identical in composition. Such a resulting structure tends to provide a resilient liner having improved integrity as compared to the prior art. In particular, liner 130, being integral with elastomer material 122, tends to advantageously resist delamination from the lobes during service. The three-dimensional network of the bonded aggregate, in addition to providing structural integrity to the lobes, tends to advantageously provide a "foothold" for the resilient liner 130.

Although the present invention and its advantages have been described in detail, it should be understood that various changes, substitutions and alternations can be made herein without departing from the spirit and scope of the invention as defined by the appended claims.

I claim:

1. A stator for use in a Moineau style power section, the stator comprising:

an outer stator tube;

a helical cavity component deployed substantially coaxially in the stator tube, the helical cavity component providing an internal helical cavity and including a plurality of internal lobes;

the helical cavity component including a composite of a reinforcing, free-flow aggregate and an elastomeric material, the reinforcing aggregate including a three-dimensional network of aggregate particles in which neighboring aggregate particles are physically bonded, the elastomeric material at least partially filling pore space between the aggregate particles;

a resilient liner deployed on an inner surface of the helical cavity component and presented to the internal helical cavity.

2. The stator of claim 1, wherein the resilient liner is substantially (i) identical in composition with the elastomeric material and (ii) integral with the elastomeric material.

3. The stator of claim 1, wherein the aggregate particles are substantially spherical in shape.

4. The stator of claim 1, wherein the aggregate particles comprise plated steel spheres, the spheres being plated with a material having a melting temperature less than that of steel.

5. The stator of claim 4, wherein said plating material is selected from the group consisting of copper, nickel, tin, zinc, chromium, and alloys thereof.

6. The stator of claim 1, wherein the neighboring aggregate particles are metallurgically bonded to one another.

7. The stator of claim 1, wherein the neighboring aggregate particles are bonded via an adhesive.

8. A stator for use in a Moineau style power section, the stator comprising:

an outer stator tube;

a helical cavity component deployed substantially coaxially in the stator tube, the helical cavity component providing an internal helical cavity and including a plurality of internal lobes;

the helical cavity component including a porous skeletal structure, the porous skeletal structure including a three-dimensional network of aggregate particles in which neighboring aggregate particles are physically bonded;

a resilient liner deployed on an inner surface of the helical cavity component and presented to the internal helical cavity.

9. The stator of claim 8, wherein selected pores in the porous skeletal structure are at least partially filled with an elastomeric material.

10. The stator of claim 9, wherein the elastomeric material is substantially (i) identical in composition with the resilient liner and (ii) integral with the resilient liner.

11. The stator of claim 8, wherein selected pores in the porous skeletal structure are at least partially filled with a metallic plating material.

12. The stator of claim 11, wherein the metallic plating material is selected from the group consisting of copper, nickel, tin, zinc, chromium, and alloys thereof 13. The stator of claim 8, wherein the aggregate particles comprise plated steel spheres, the spheres being plated with a material having a melting temperature less than that of steel.

14. The stator of claim 8, wherein the neighboring aggregate particles are metallurgically bonded to one another.

15. The stator of claim 8, wherein the neighboring aggregate particles are bonded via an adhesive.

16. A subterranean drilling motor comprising:

a rotor having a plurality of rotor lobes on a helical outer surface of the rotor;

a stator including a helical cavity component deployed substantially coaxially in and retained by a stator tube, the helical cavity component providing an internal helical cavity and including a plurality of internal lobes, each of the lobes including a composite of a reinforcing, free-flow aggregate and an elastomeric material, the reinforcing aggregate including a three-dimensional network of aggregate particles in which neighboring aggregate particles are physically bonded; the three-dimensional network of aggregate particles disposed to structurally support the lobes, a resilient liner deployed on an inner surface of the lobes; and the rotor deployable in the helical cavity of the stator such that an outer surface of the rotor is in a rotational interference fit with the resilient material.

17. The drilling motor of claim 16, wherein the resilient liner is substantially (i) identical in composition with the elastomeric material and (ii) integral with the elastomeric material.

18. The drilling motor of claim 16 wherein the aggregate particles are substantially spherical in shape.

19. The drilling motor of claim 16, wherein the aggregate particles comprise plated steel spheres, the spheres being plated with a material having a melting temperature less than that of steel.

20. The drilling motor of claim 16 wherein the neighboring aggregate particles are metallurgically bonded to one another.

21. The drilling motor of claim 16, wherein the neighboring aggregate particles are bonded via an adhesive.

22. A method of fabricating a Moineau style stator, the method comprising:

(a) deploying a first stator core substantially coaxially into a stator tube, the stator core having at least one helical lobe on an outer surface thereof such that a first helical cavity is formed between the first stator core and the stator tube;

(b) filling the first helical cavity with a free flow aggregate;

(c) bonding the free flow aggregate to form a porous, three-dimensional network of aggregate particles in which neighboring aggregate particles are physically bonded;

(d) removing the first stator core;

(e) deploying a second stator core in the stator tube, the second stator core having smaller major and minor diameters than the first stator core such that a second helical cavity is formed between the second stator core and the bonded aggregate particles;

(f) injecting a resilient material into the second helical cavity, the resilient material substantially filling the second helical cavity and at least partially filling pore space between said bonded aggregate particles; and (g) removing the second stator core.

23. The method of claim 22, wherein the aggregate particles are substantially spherical in shape.

24. The method of claim 22, wherein the aggregate particles comprise plated steel spheres, the spheres being plated with a material having a melting temperature less than that of steel.

25. The method of claim 22, wherein (c) further comprises heating the stator tube to a sufficiently high temperature to fuse the neighboring aggregate particles to one another.

26. The method of claim 22, wherein (c) further comprises percolating at least one of (i) a liquid adhesive and (ii) a metallic plating material through the free flow aggregate.

27. The method of claim 22, wherein (c) further comprises:

(i) percolating a metallic plating material powder through the free flow aggregate; and (ii) heating the stator tube to a temperature greater than a melting temperature of the metallic plating material.

* * * * *